US006491238B1

(12) United States Patent
Swanson et al.

(10) Patent No.: US 6,491,238 B1
(45) Date of Patent: Dec. 10, 2002

(54) ROTARY SPA JET INCORPORATING A ROTATING NOZZLE SUPPORTED BY A RADIAL BALL BEARING INTENDED TO REDUCE CLOGGING OF THE BEARING

(75) Inventors: Darrin Swanson, Simi Valley, CA (US); Jack Buck, Simi Valley, CA (US); Paul Beaumont, South Yorkshire (GB); Alan Sheard, West Yorkshire (GB)

(73) Assignee: Pentair Pool Products, Inc., Moorpark, CA (US)

( * ) Notice: Subject to any disclaimer, the term of this patent is extended or adjusted under 35 U.S.C. 154(b) by 0 days.

(21) Appl. No.: 10/008,421

(22) Filed: Nov. 13, 2001

(51) Int. Cl.[7] ..... B05B 15/08

(52) U.S. Cl. ..... 239/587.4; 239/587.1; 239/251; 239/259; 239/590.5; 239/381; 4/541.6

(58) Field of Search ..... 239/225.1, 251, 239/259, 261, 380, 381, 587.1, 587.4, 590, 590.5; 4/541.1, 541.6

(56) References Cited

U.S. PATENT DOCUMENTS 5,333,791 A * 8/1994 Carlo ..... 239/587.4
5,353,447 A * 10/1994 Gravatt ..... 239/587.1
5,657,496 A * 8/1997 Corb et al. ..... 239/587.1
5,810,257 A * 9/1998 Ton ..... 239/259
5,956,784 A 9/1999 Perdreau et al.
5,983,417 A 11/1999 Perdreau et al.
6,123,274 A 9/2000 Perdreau et al.
6,178,570 B1 1/2001 Denst et al.
6,264,122 B1 7/2001 Perdreau et al.
6,322,004 B1 11/2001 Perdreau et al.

* cited by examiner

*Primary Examiner*—Steven J. Ganey
(74) *Attorney, Agent, or Firm*—Christie, Parker & Hale, LLP

(57) ABSTRACT

A rotary spa jet, of the type which comprises a nozzle rotatably mounted within the end of a spa jet housing by a radial ball bearing, is provided with an internal flow guide to reduce impairment of the free rotation of the nozzle caused by debris in the spa water. The flow guide is positioned within the spa jet housing and acts on a portion of the water flow which reaches and flows through the radial ball bearing to flush and lubricate it. The flow guide includes one or more annular baffle walls which deflect water flow which reduce the amount of water that flows through the bearing and slows down its rate of flow to promote settlement and collection of debris before it reaches the bearing.

7 Claims, 3 Drawing Sheets

Figure 1:
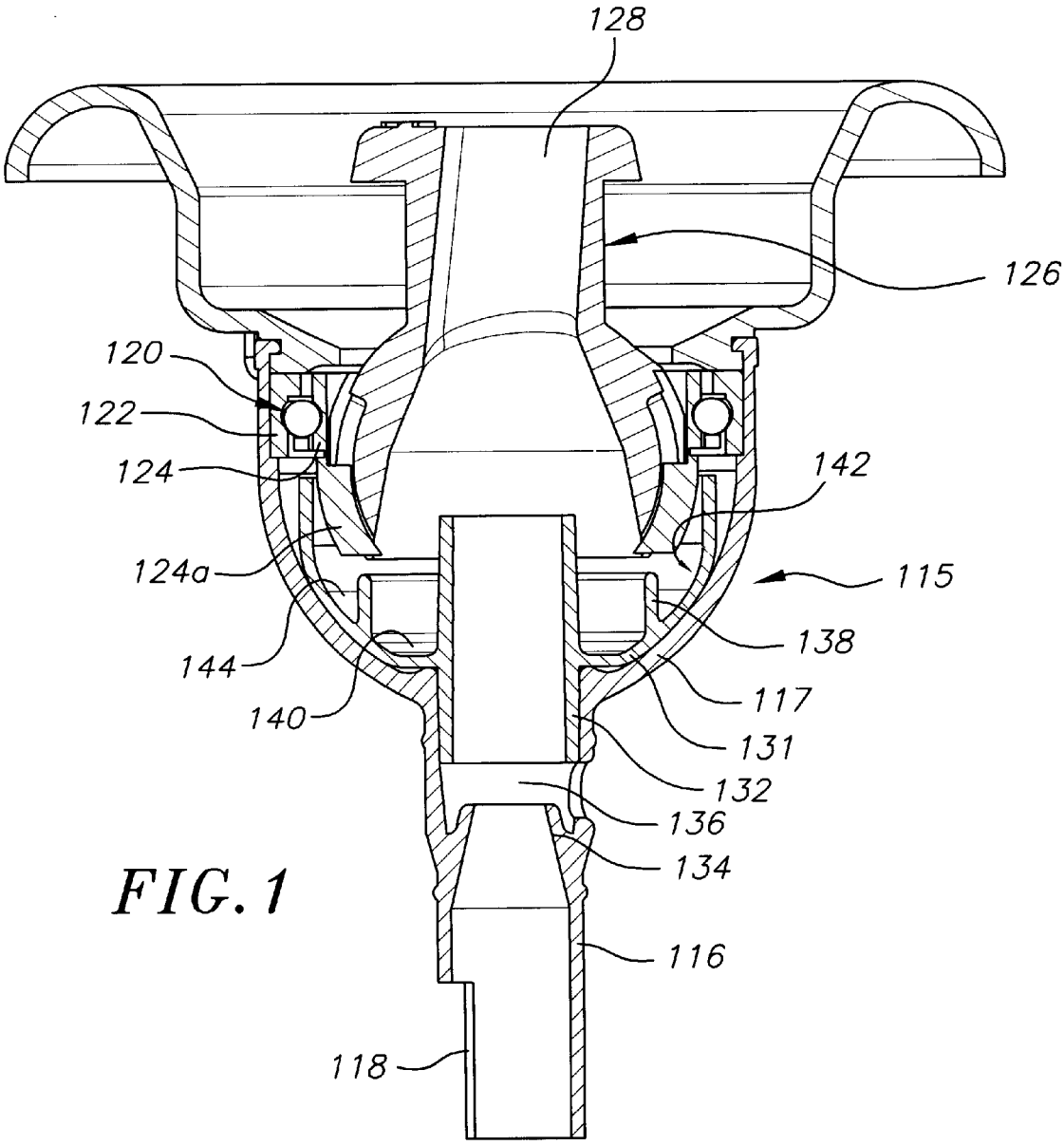

ROTARY SPA JET INCORPORATING A ROTATING NOZZLE SUPPORTED BY A RADIAL BALL BEARING INTENDED TO REDUCE CLOGGING OF THE BEARING

BACKGROUND OF THE INVENTION

This invention relates to spa jets for hydrotherapy. In particular, it relates to a spa jet having a rotating nozzle supported by a radial ball bearing in which clogging of the bearing by debris in the spa water is reduced.

In the art of hydrotherapy, it is known to utilize spa jets which direct a stream of water into the spa through one or more nozzles which rotate to distribute the water in a swirling motion against the skin of a person in the spa. Such a spa jet typically includes a housing, which communicates with an inlet connected to a pressurized source of water, and a radial ball bearing, mounted within the open end of a cup-shaped portion of the housing, which supports the nozzle for rotation. The nozzle has a nozzle passage which is angularly and radially offset from the central axis of the spa jet so that the water jet exerts a turning moment to the nozzle to rotate it. One such spa jet of the type described is disclosed in U.S. Pat. No. 6,123,274 to Perdreau et al., owned by the assignee of the present invention.

While spa jets of the type described are generally satisfactory for their intended purpose, debris within the spa water can, over time, impair the free rotation of the radial ball bearing supporting the nozzle. Build-up of debris in the bearing can eventually slow down rotation of the nozzle to an unacceptable rate and, in an ultimate condition, cause it to stop rotating. This impairment can have several causes. For example, there will usually be gummy substances within the spa water, such as body oils or suntan oil, which build up over time on ball bearings, and on other rotary surfaces, within the rotary bearing. In addition, there will usually be fine particulates, such as sand or insoluble earth particles and undissolved particulate residues from the chlorine-containing tablets used in the spa to kill bacterial organisms. There may also be human hair and also particles of plastic. These particles can enter and wedge against, or roughen, the surfaces of rotating parts thereby causing them to slow down or cease to rotate. For purposes of this patent, we will use the term "debris" to refer collectively to all substances dissolved, suspended, entrained or otherwise present in the spa water, that tend to impair free rotation of the radial ball bearing. We will also use the word "clogging" to generically describe any interference with rotation of the rotary bearing caused by the debris.

While rotary spa jets, of the type described, will operate for long periods before the rotation of the spa jet becomes impaired to the point of inutility, it is an objective of this invention to extend the life of the spa jet by minimizing the clogging of the rotary bearing.

SUMMARY OF THE INVENTION

The present invention provides an improvement to a spa jet of the type having an inlet tube, supplied by an upstream source of water under pressure, a cup-shaped housing extending and flaring outwardly from a downstream end of the inlet tube, a radial ball bearing having outer and inner races mounted within and surrounding the downstream end of the housing and a nozzle member mounted to the inner race, wherein there is a nozzle passage through the nozzle member which is offset relative to the central axis so that the water jet leaving the nozzle causes the nozzle to rotate. A minor part of the water flow is directed through the bearing to lubricate and flush it.

The improvement resides in structure which reduces and slows down flow of water internally within the spa jet reaching the radial ball bearing. The invention thereby diminishes the amount of debris within the water that passes through the bearing thereby prolonging the life of the bearing before it becomes unacceptedly slowed in its freedom to rotate.

In particular, the present invention provides a generally cup-shaped flow guide, mounted within the housing, which includes at least one baffle wall that reduces the amount of water and debris within it that reaches the bearing. The baffle wall extends towards the adjacent surfaces of the nozzle member to guide flow back toward the nozzle and thus reduce the flow reaching the bearing. In addition to reducing the amount of water flowing to the bearing, the baffle wall also reduces the turbulence to cause settlement of some of the debris before the water reaches the bearing. Any settled-out particulates can collect in a first debris pocket defined by the region between the flow tube and the baffle wall.

The flow guide also provides a second baffle wall which extends axially to a position spaced closely adjacent to the rotary bearing, with only a small gap through which water can flow to the bearing so that the flow of water reaching the rotary bearing is further reduced. Additional settlement of some of the debris will occur and it is collected in a second debris pocket between the two baffle walls.

The intended result of the improved structure described is to prolong the time for which the nozzle member can rotate before significant impairment is caused by debris reaching the radial ball bearing.

DETAILED DESCRIPTION OF THE DRAWINGS

Figure 2:
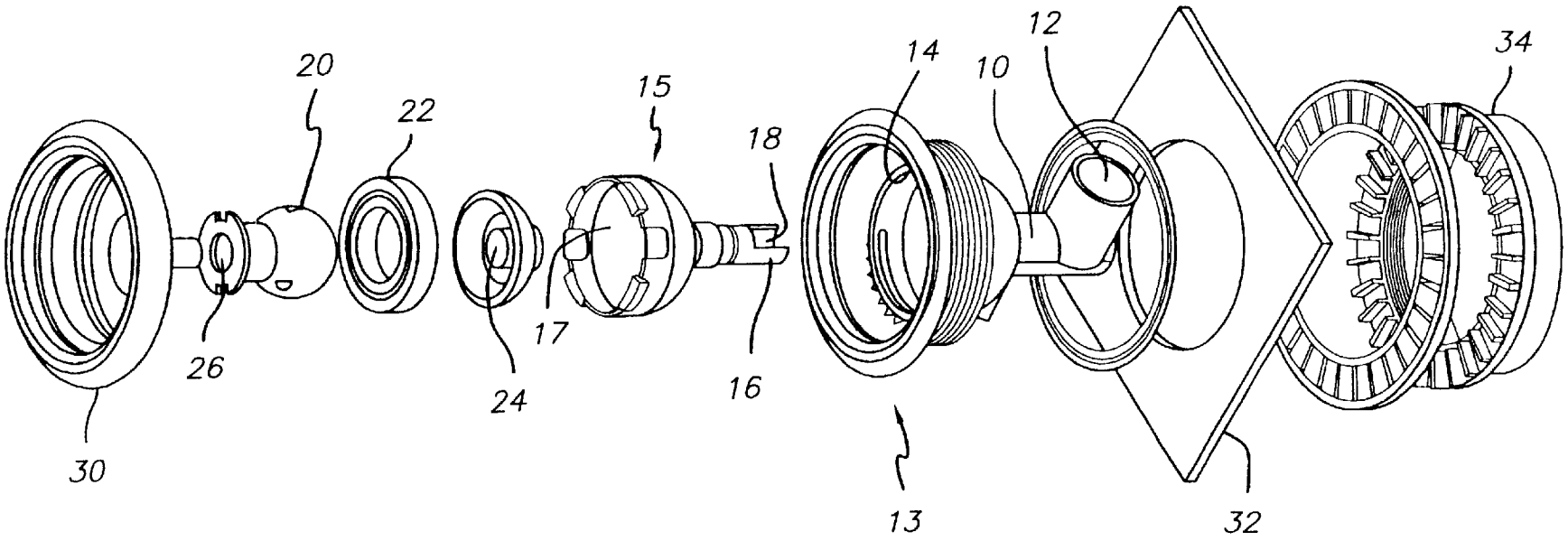
FIG. 2 PRIOR ART
Figure 3:
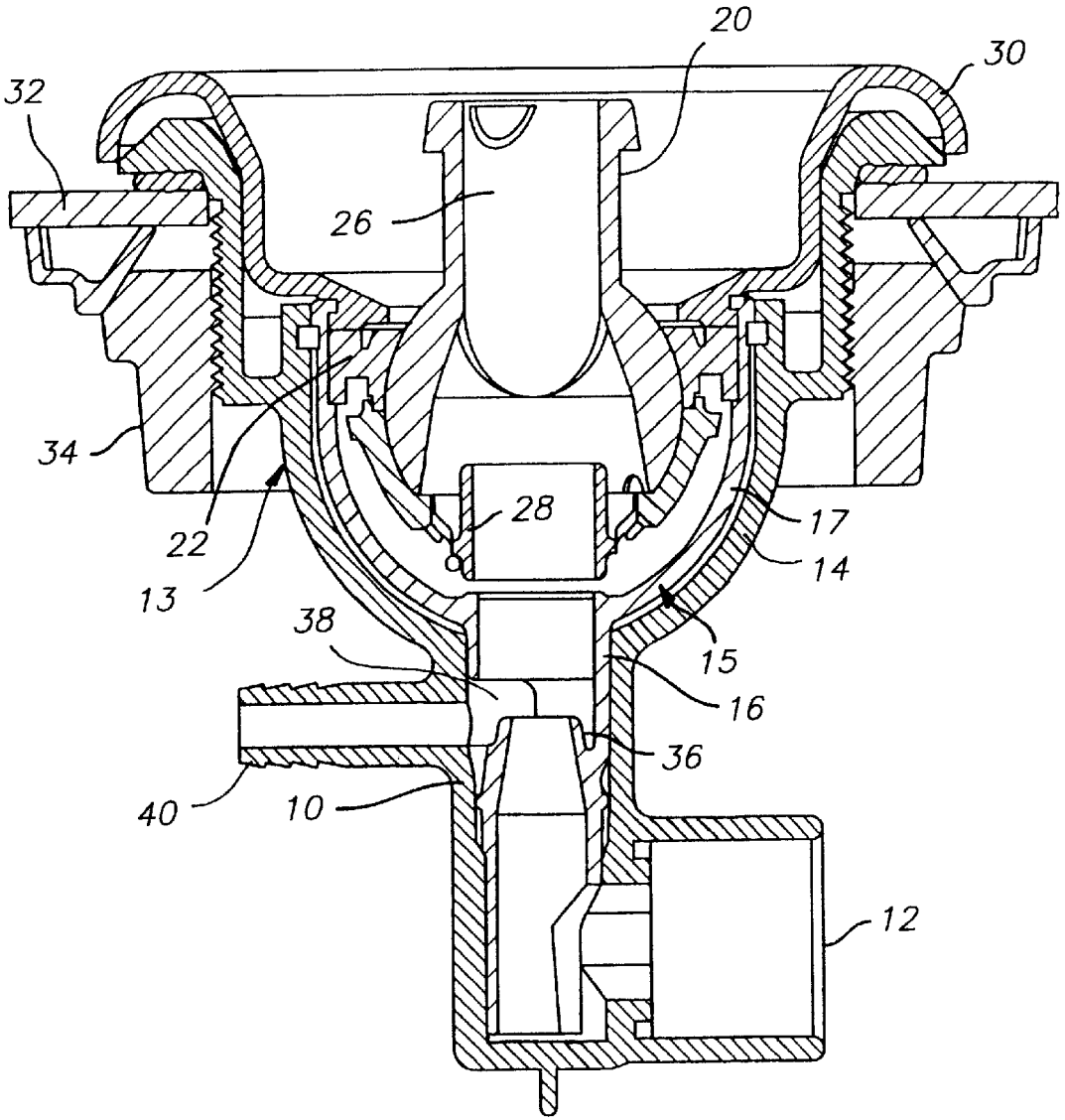
FIG. 3 PRIOR ART

FIG. 1 is a cross-sectional view, taken along its longitudinal axis, of a spa jet of the present invention intended to reduce clogging of its radial ball bearing;

FIG. 2 is an exploded, perspective view of a spa jet according to the prior art, in particular, as shown in U.S. Pat. No. 6,123,274, also owned by the assignee of the present application; and FIG. 3 is a cross-sectional view, taken along the longitudinal axis, of a portion of the prior art spa jet shown in FIG. 2.

DETAILED DESCRIPTION OF THE INVENTION

Before describing the improvement of the present invention, we will describe a spa jet structure of the prior art as shown in FIG. 2 of commonly owned U.S. Pat. No. 6,123,274, which is exemplary of spa jets to which the present improvement may be applied.

The prior spa jet receives water from a pressurized upstream source (not shown). The water enters an axially-extending inlet tube 10 through a right angle port 12 communicating with the water source. The inlet tube 10 is part of an outer housing 13 which also includes a cup-shaped outer chamber wall 14 defining an outer chamber. The outer housing 13 encloses a housing 15. The housing 15 includes an inlet tube 16 and a chamber wall 17 defining a cup-shaped chamber. The housing 15 is mounted for selective rotation and locking relative to the outer housing 13 about a central axis common to both housings. A side slot 18 at the upstream end of the inlet tube can be rotated relative to the port 12, by selectively rotating the housing 15 within the outer housing 13, to control the amount of water that flows through the spa jet. Water passing through the housing 15 is delivered to a rotating nozzle member 20 which is supported for rotation by a radial ball bearing 22. An intermediate tube 24 directs water from the tube 16 into a nozzle passage 26 through the nozzle member. The nozzle passage ejects a water jet which is radially and angularly offset from the central axis of the spa jet and causes the nozzle to rotate within the housing and thus provide the desired rotating jet sensation on the skin of a user of the spa. Two further features of this prior art device may be briefly noted. An adjustment ring 30 is connected to the downstream end of the housing 15 and can be rotated by the user in the spa to rotate the inner housing, and, hence, the slot 18 in relation to the port 12, and thereby vary the flow through the spa jet. The outlet housing is mounted to the spa wall 32 through an opening therein and it is clamped in position by a threaded mounting ring 34 which engages a correspondingly threaded region on the outer housing 13.

The structure of the prior art spa jet is shown in further detail in cross-section in FIG. 3. A first nozzle 36 within the interior of the inlet tube 16 accelerates the water into a mixing chamber region 38 where the water is mixed with air entering from an air source via a tubular side port 40 and a slot in the inlet tube 16. The aerated water is directed from the mixing chamber 38, via the intermediate tube 24 into the passage 26 through the body of the rotating nozzle 20, as already described. As can be seen from FIG. 3, some of the water passes along the region adjacent to the inner chamber wall to the bearing 18 through which it reaches the spa. The diversion of some of the water flow through the bearing 22 is intended to lubricate the bearing parts and flush them out. Nonetheless, over a long period of time, debris within the water passing through the bearing can impair the freedom of rotation between the inner and outer races of the radial ball bearing, thereby slowing down and, even ending, the rate of rotation of the nozzle.

The present invention is intended to provide a spa nozzle which reduces the flow of debris through the radial ball bearing and thereby significantly delay the build-up of debris within the bearing and extend its effective working life. The structure which provides applicants' invention is shown in FIG. 1.

Because the structure and operation of the invention described in the prior U.S. Pat. No. 6,123,274 is the same as some of the parts of the structure of the present invention, e.g., the outer housing, adjustment ring and the structure for mounting the housing to the spa wall, and the arrangement of resilient tabs formed on certain of the parts which snap into mating grooves on their complementary parts to hold the spa jet together, the disclosure of U.S. Pat. No. 6,123,274 is incorporated herein by reference.

The spa jet of the present invention (FIG. 1) employs an outer housing generally corresponding to the outer housing 13 already described in the prior art, together with the already-described clamping structure for mounting the spa jet to the pool wall. The outer housing is not shown in FIG. 1 although these components are present in the spa jet of the present invention. The structure shown in FIG. 1 includes a housing 115, externally configured to fit within the previously-described outer housing 13, having an inlet tube 110 and a chamber wall 117 defining a generally cup-shaped chamber. The inlet tube includes a slot 118 which can be rotated relative to the inlet port 12 to control the flow of water through the spa jet. However, the structure of the present invention is significantly changed from the prior art in various respects, as will now be described.

The present invention uses a radial ball bearing 120 which includes an outer annular race 122 fixedly secured to the interior of the inner chamber wall 117 around its downstream end. The radial ball bearing also has an inner race 124 concentrically mounted to the outer race, by a conventional cage and array of ball bearings, for free running rotation of the inner race within the outer race. The inner race 124 has an annular skirt region **124*a* extending axially towards the inlet tube in aligned, spaced relation to it. The inner race, including the skirt region, has an interior surface which is eyeball shaped to receive a mating eyeball-shaped base region of a rotatable nozzle 126. The rotatable nozzle 126 includes a central passage 128 which includes a convergent entry region adjacent its upstream end and a convergent venturi region adjacent its downstream end which ejects a water jet. The water jet is offset from the central axis of the housing so that the jet exerts a turning moment on the nozzle which rotates the nozzle about the central axis. In the preferred embodiment, two nozzle passages are provided, with the two passages being configured and positioned to exert turning moments which are complemental. The interior and exterior surfaces of the eyeball region of the nozzle member have complementally engaging grooves, permitting relative angular adjustment within a range limited by facing shoulders 64 and 66. The inlet tube 116 includes an internal first nozzle which accelerates the water into an air mixing chamber 136**, to aerate the water stream.

Of particular interest to the present invention is a flow guide 130 intended to reduce the debris which passes through the bearing. The flow guide 130 includes a generally cup-shaped inner wall 131, generally conforming to the shape of the chamber wall 117 in the region surrounding its upstream end. The inner wall 131 carries a flow tube 132 which guides a major portion of the water from the inlet tube 116 into the nozzle passage 128.

Flow of debris that can reach and flow through the radial ball bearing is reduced by two annular baffle walls forming part of the flow guide 130. An inner baffle wall 138 extends axially from the inner wall 131 in approximate radial alignment with the periphery of the adjacent opening in the nozzle passage 128 through the open end of the skirt **124*a* of the inner race. The inner baffle wall 138 extends axially towards the edge of the skirt 124*a* on the inner race and leaves only a small annular gap through which water can flow through the inner chamber to the rotary bearing. Thus, the baffle wall guides part of the water flow back into the nozzle. The baffle wall also reduces the speed of flow of water passing to the radial ball bearing, promoting settlement of some of its debris in the waters. A region 140 between the flow tube 132 and the inner baffle wall comprises a first debris collection pocket in which some of the settled materials tend to accumulate. The restriction on flow achieved by the inner baffle wall 138**, and the settlement of some of the undissolved material in the debris into the first debris pocket, are intended to reduce the amount of debris that enters the radial ball bearing over its life.

The flow guide also provides an outer baffle wall 142. It is constituted by the downstream radially outer region of the inner wall 130. The outer baffle wall 142 extends axially, parallel to the central axis, to a point where it is spaced closely from the outer surface of the lower region of the inner race, leaving only a small gap through which water can pass to the radial ball bearing. Again, the flow towards the bearing is not only reduced but slowed down, causing some of the debris to settle out. There is a region between the baffle walls 138 and 142 which constitutes a second debris-collecting pocket 144 into which settled debris may accumulate. The provision of the outer baffle wall 142, and the second debris collection pocket 144 should further reduce the amount of debris that can potentially interfere with the free rotation of the nozzle over the life of the spa jet, thereby extending its useful life.

Since it is a matter of customer dissatisfaction to have to remove and replace rotary spa jets when they reach the end of their effective rotary life, the reduction of clogging achieved by this invention should be of considerable benefit to owners of spas, and to those who service and supply them, in prolonging spa jet life. An increase in the time that the spa jet can last before it needs replacement, or servicing, should be of considerable value to the persons who use this invention.

Although the invention has been described with reference to one preferred embodiment, it will be understood by those skilled in the art that the invention is not confined to the particular preferred embodiment disclosed. For example, while the inventive structure has been described in use with the particular prior art spa jet of U.S. Pat. No. 6,123,274, it is not limited to use with only that structure but may be employed with other spa jets where delayed clogging of a radial ball bearing is desired. Variations that would be evident to a person of ordinary skill in this art are insubstantial and do not serve to avoid the definitions of the inventions provided by the appended claims.

What is claimed is:

1. A spa jet for delivering water from an upstream source of water under pressure to the interior of a spa, the water containing debris, the spa jet comprising:

at least one housing having an inlet tube communicating with the source of water and a chamber wall defining a generally cup-shaped chamber extending downstream from said inlet tube along a common axis therewith;

a radial ball bearing having an outer race secured to said chamber wall adjacent a downstream end thereof and an inner race supported by said outer race for rotation about said axis;

a nozzle member fixed to and carried by said inner race;

at least one nozzle passage extending axially through said nozzle member, angularly and radially offset from said axis, to eject a jet of water which creates a turning moment that rotates said nozzle member about the central axis;

a flow guide mounted within said chamber wall, said flow guide including:

a generally cup-shaped inner wall mounted within said chamber wall;

a flow tube connected to said inner wall extending therethrough positioned to direct water flowing through said inlet tube into said nozzle passage, said flow tube also permitting some water to pass to said radial ball bearing; and at least one baffle wall extending axially from said inner wall substantially around said flow tube, spaced radially therefrom, to reduce the amount of debris that passes through the radial ball bearing.

2. A spa jet as defined in claim 1 wherein said nozzle member and said inner race have complemental surfaces defining an eyeball bearing which permits the angular position of said nozzle passage relative to the housing axis to be selectively varied within a predetermined range thereby varying the rate of rotation of said nozzle member.

3. A spa jet as defined in claim 1 wherein said baffle wall has a periphery which is in general radial alignment with adjacent portions of said inner race.

4. A spa jet as defined in claim 1 wherein said baffle wall has a periphery which is in general radial alignment with a junction of said inner and outer races and extends axially into close proximity with the exterior of said inner race leaving a limited gap there between through which water may reach said bearing.

5. A spa jet as defined in claim 4 wherein there are two of said baffle walls arranged in concentric relation, an inner one of said baffle walls being aligned generally with adjacent regions of said inner race and an outer one of said baffle walls being generally aligned with a junction between said inner and outer races.

6. A spa jet as defined in any of claims 1–5 further including:

an outer housing having an outer inlet tube communicating with the source of water and an outer chamber wall defining a generally cup-shaped outer chamber extending downstream from said outer inlet tube, said outer housing being complementally shaped to receive and enclose said one housing for selective rotation between said housings about said axis;

an inlet port connected to said outer inlet tube adjacent its upstream end and communicating with the source of water;

a slot through said inlet tube of said one housing positioned for selective, progressive rotation between a fully open position, in which said slot permits unobstructed flow from said inlet port into said inlet tube, and a fully closed position, in which said slot is not aligned to receive any flow from said inlet port; selective rotation of said one housing relative to said outer housing thereby selectively controlling the flow of water through said one housing; and an adjusting ring connected to said one housing adjacent its downstream end thereby enabling a user in the spa to rotate said one housing relative to said outer housing and vary the water flow through said nozzle passage.

7. A spa jet as defined in claim 1 further wherein said baffle wall causes some debris within the water reaching said baffle wall to settle, said spa jet further including:

a debris pocket in said flow guide positioned on an upstream side of said one baffle wall to collect debris settling from the water.

* * * * *